US005915853A

United States Patent [19]

Guilin

[11] Patent Number: 5,915,853

[45] Date of Patent: Jun. 29, 1999

[54] MAGNET DRIVE SYSTEM FOR AN ANIMATED DISPLAY

[75] Inventor: Xing Guilin, Shenzhen, China

[73] Assignee: Mr. Christmas, Inc., New York, N.Y.

[21] Appl. No.: 08/535,825

[22] Filed: Sep. 28, 1995

[51] Int. Cl.[6] ..... G09F 19/08

[52] U.S. Cl. ..... 40/414; 40/415; 40/426

[58] Field of Search ..... 40/414, 415, 426, 40/430; 475/11

[56] References Cited

U.S. PATENT DOCUMENTS

| | | | |
|---|---|---|---|
| 398,664 | 2/1889 | Sleeper | 475/11 |
| 1,323,902 | 12/1919 | Obolewicz | 40/415 X |
| 1,338,944 | 5/1920 | Majewski | 40/415 X |
| 2,282,430 | 5/1942 | Smith | 40/426 |
| 2,471,002 | 5/1949 | Mohr . | |
| 2,527,803 | 10/1950 | Fleak | 475/11 X |
| 2,645,880 | 7/1953 | Richter | 446/136 X |
| 3,103,360 | 9/1963 | Miller et al. . | |
| 3,510,949 | 5/1970 | Christy | 40/426 X |
| 3,532,341 | 10/1970 | Shaw . | |
| 3,823,941 | 7/1974 | Ochi et al. . | |
| 4,177,592 | 12/1979 | Ruck | 40/426 |
| 4,644,809 | 2/1987 | Howse | 475/11 X |
| 4,838,825 | 6/1989 | Hwang et al. | 446/136 |
| 5,255,461 | 10/1993 | Chiou | 40/415 |

*Primary Examiner*—Joanne Silbermann
*Attorney, Agent, or Firm*—Fitzpatrick, Cella, Harper Scinto

[57] ABSTRACT

A drive mechanism for an animated display includes a plurality of planetary gears supported on a rotatable planetary gear support. Each planetary gear meshes with a stationary sun gear and is affixed to a multi-finger magnet support. Rotation of the planetary gear support causes the magnet support to revolve about the sun gear and also to rotate about its own central axis. One magnet from a first set of magnets is supported in each finger of the magnet support and travels in a first orbit about the rotational axis of its respective magnet support and in a second orbit around the sun gear. The rotatable planetary gear support can also support a second set of magnets for orbital movement about the sun gear. An optional auxiliary magnet support rotates about a center axis of the sun gear and supports a third set of magnets for orbital movement.

60 Claims, 10 Drawing Sheets

MAGNET DRIVE SYSTEM FOR AN ANIMATED DISPLAY

BACKGROUND OF THE INVENTION

1. Field of the Invention

The present invention relates generally to an animated display device having figurines that are moved over a display surface by magnetic forces. More particularly, the present invention relates to a drive system for driving magnets that move the figurines in the animated display device.

2. Description of the Prior Art

Using the magnetic force of magnets to move figurines over a display surface has been done for many years. Typically, a display surface of a toy will be formed to represent some type of recreational area such as, for example, a skating rink, a race track, etc., and one or more magnets will be supported for movement just beneath the display surface. As the magnetic force attracts the figurine, movement of the magnet maneuvers the figurine such as an ice skater or a race car over the display surface. Along with many different kinds of display surfaces, many types of drive systems for moving the magnets below the display surface have been proposed through the years. One type of recreational area that has proven to be popular is a skating rink. For example, U.S. Pat. No. No. 4,838,825 (Hwang et al.) discloses a toy kiddieland wherein the display surface includes a skating rink, an undulating track and a play area that includes swings, all of which have figurines that are moved by the magnetic force of magnets. Beneath the display surface is a plate rotatably mounted on a base and equipped with a plurality of magnets. Magnets positioned beneath the skating rink are mounted in pairs on either end of a rotary shaft. The pairs of magnets revolve with the rotating plate and can also rotate about their respective shafts through attraction to a stationary magnet secured to the base of the display. Additional magnets are mounted on vertically movable shafts for moving figurines, such as cars, over the track, and magnets secured to the outer periphery of the plate move the swinging displays.

U.S. Pat. No. 2,645,880 (Richter) discloses another type of animated skating rink. In this patent, magnets are moved below the skating surface by an endless belt. A drive gear and a plurality of idler gears are provided to support and drive the belt in a tortuous path. Additional magnets are supported and driven in independent paths by a supplemental drive system, which also uses an endless belt.

A different type of toy is disclosed in U.S. Pat. No. 3,510,949 (Christy) wherein a figurine is moved over a flat surface in a geometric pattern. The figurine is equipped to hold a writing instrument for tracing its geometric path on a piece of paper placed on the flat surface. The drive mechanism in this patent utilizes a plurality of planetary gears rotatably mounted on a gear base and keyed to a stationary sun gear. A quadripole magnet is eccentrically mounted to each planetary gear. As the base rotates, the planetary gears revolve around the sun gear and rotate about their own axis to effect movement of the magnets.

However, the magnet drive systems discussed above, and those generally known, have certain limitations in the manner and patterns in which the magnets are driven. Thus, an improved magnet drive system, or mechanism, is desirable for providing better movement of figurines over a display surface.

SUMMARY OF THE INVENTION

It is a general object of the present invention to provide an animated display with improved movement of figurines over a display surface.

It is therefore an object of the present invention to provide an improved drive mechanism for driving magnets below a surface of an animated display device.

It is still another object of the invention to provide a magnet drive mechanism for driving each magnet in a first set of magnets in a first orbit about a central axis of the drive mechanism and in a second orbit smaller than the first orbit.

It is yet another object of the invention to provide a magnet drive mechanism for driving a second set of magnets in a pattern independent from the first set of magnets.

It is still another object of the invention to provide a magnet drive mechanism for driving a third set of magnets in a pattern independent from the first and second sets of magnets.

In accordance with one aspect of the invention, a magnet drive system for an animated display comprises a base, a sun gear fixed to the base, a planetary gear support having a central axis and mounted for rotational movement about a center axis of the sun gear, and first drive means for rotating the planetary gear support. At least one planetary gear is rotatably supported on the planetary gear support and meshes with the sun gear such that rotation of the planetary gear support rotates the planetary gear about its own rotational axis and revolves the planetary gear about the central axis. The magnet drive system also includes a magnet support platform affixed to the planetary gear and at least one magnet supported in the magnet support platform. With this arrangement, rotation of the planetary gear support will revolve the magnet in a first pattern about the rotational axis of the planetary gear and in a second pattern about the central axis of the planetary gear support.

In accordance with another aspect of the invention, a magnet drive system for an animated display comprises a base, a sun gear fixed to the base, a planetary gear support having a central axis and mounted for rotational movement about a center axis of the sun gear, and first drive means for rotating the planetary gear support. In addition, at least one planetary gear is rotatably supported on the planetary gear support and meshes with the sun gear, wherein rotation of the planetary gear support rotates the planetary gear about its own rotational axis and revolves the planetary gear about the central axis. A magnet support platform is affixed to the planetary gear for supporting a first set of magnets. An auxiliary magnet support is mounted for rotation about the central axis of the planetary gear support, and a second drive means is provided for rotating the auxiliary magnet support. The planetary gear support includes means for supporting a second set of magnets and the auxiliary magnet support includes means for supporting a third set of magnets. In this arrangement, rotation of the planetary gear support moves the first set of magnets in a first pattern about the rotational axis of the planetary gear and in a second pattern about the central axis of the planetary gear support and moves the second set of magnets in a third pattern about the central axis of the planetary gear support. Rotation of the auxiliary magnet support by the second drive means moves the third set of magnets in a fourth pattern about the central axis of the planetary gear support.

In yet another aspect of the invention, an animated display device comprises a base, a sun gear fixed to the base, a planetary gear support having a central axis and mounted for rotational movement about a center axis of the sun gear, and first drive means for rotating the planetary gear support. At least one planetary gear is rotatably supported on the planetary gear support and meshes with the sun gear, wherein rotation of the planetary gear support rotates the planetary gear about its own rotational axis and revolves the planetary gear about the central axis. First magnet support means for supporting a first set of magnets is affixed to the planetary gear for rotation, and at least one magnet is supported in the first magnet support means. The display device also includes display means for displaying animated figures for movement over a surface by the magnets moving below the surface. Rotation of the planetary gear support revolves the first set of magnets in a first pattern about the axis of the planetary gear and in a second pattern about the central axis of the planetary gear support.

Accordingly, the present invention provides a magnetic drive system that causes at least one group of figurines to move in a seemingly random pattern, thereby to simulate real-life motion.

These and other objects, aspects, features and advantages of the present invention will become apparent from the following detailed description of the preferred embodiments taken in conjunction with the accompanying drawings.

DESCRIPTION OF THE PREFERRED EMBODIMENTS

Figure 1:
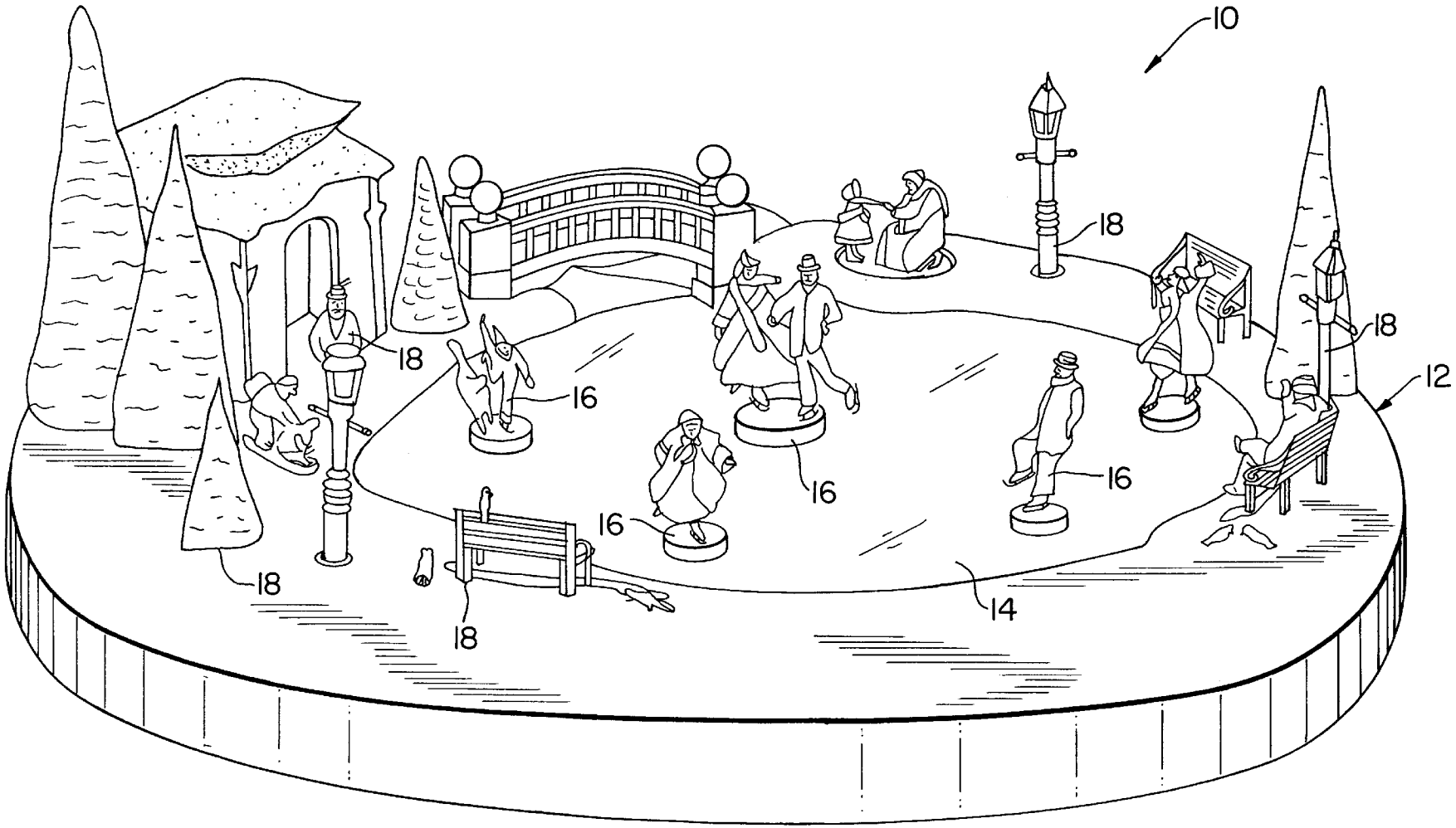
FIG. 1 is a perspective view of an animated display device in accordance with a first embodiment of the invention, showing a platform of the display device.

FIG. 1 is a perspective view of a first embodiment of an animated display device 10 in accordance with the present invention. As shown in this figure, a platform 12 of the animated display device is provided with a skating surface 14 on which mobile figurines 16 are placed. The mobile figurines are maneuvered over the skating surface by a magnetic force supplied by magnets supported beneath the skating surface and moved by a drive mechanism that will be discussed in detail below.

In addition to the skating figurines, a plurality of stationary FIGS. 18 and other types of animated displays such as trees, benches, animals, a pavilion, and the like, are provided on the platform.

Figure 2:
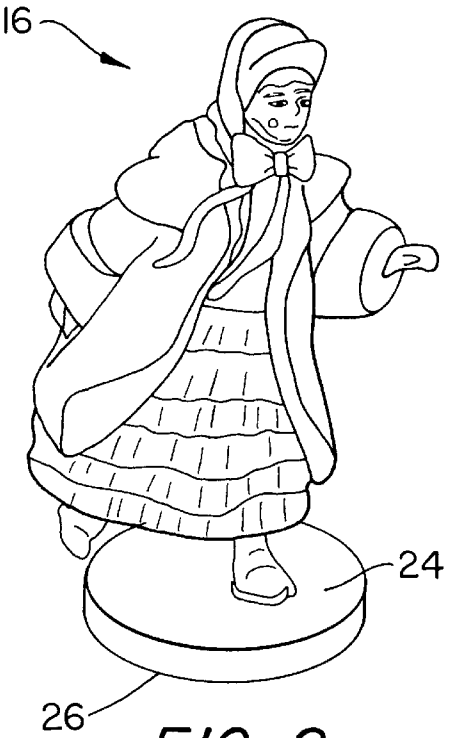
FIG. 2 is a perspective view of a figurine in accordance with the present invention.

As shown in FIG. 2, each mobile FIG. 16, or figurine, is provided with a metal base 24 and a layer of felt 26 covering the bottom surface of the metal base. The metal bases in this embodiment are not magnetized. However, the use of magnetic bases for the figurines is conventional and could optionally be provided. The felt covering helps the figurines to glide smoothly over the skating surface.

Figure 3:
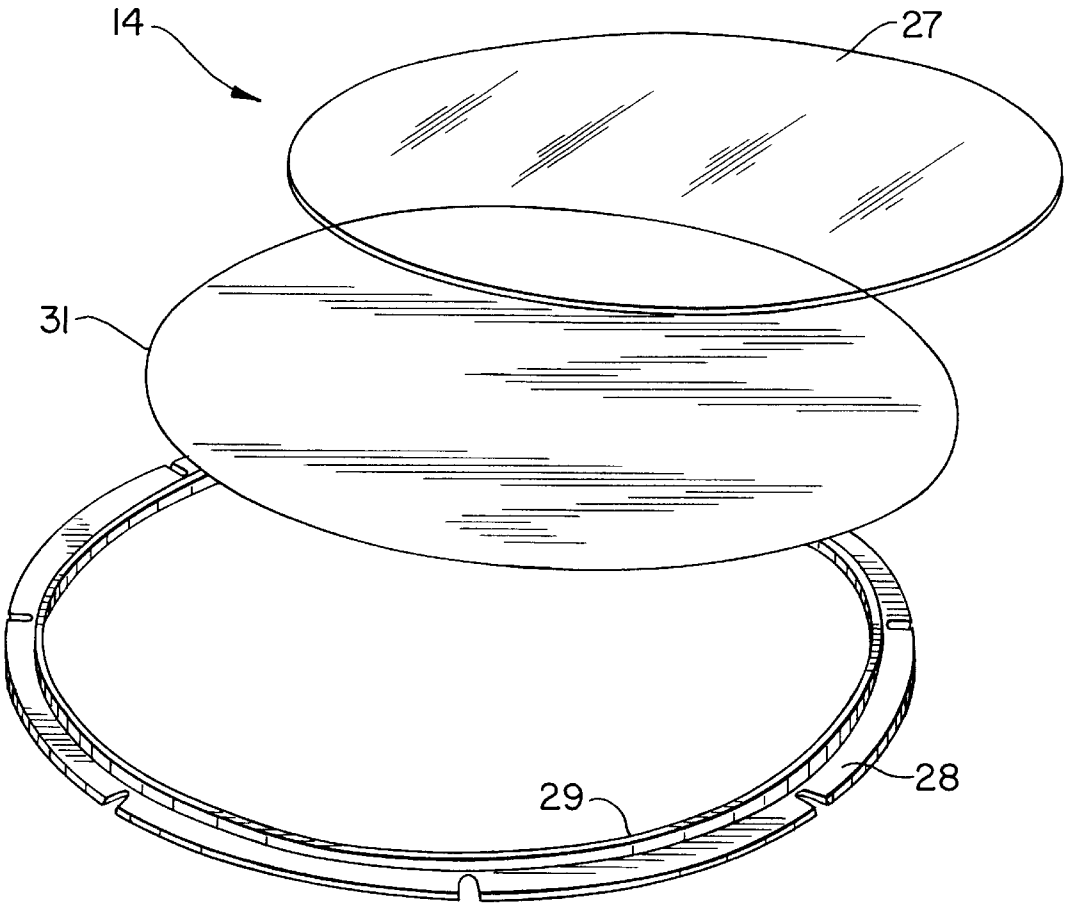
FIG. 3 is an exploded perspective view of a skating surface of the animated display device in accordance with the present invention.

As shown in FIG. 3, the skating surface 14 can be a thin plate of glass 27, on the order of ⅛ inch thick, that sits in a flat support 28 having an upstanding rim 29. A thin white backing 31 can be placed between the glass plate and the support to provide an ice-like color to the skating surface. The glass plate support is preferably positioned directly below the platform and secured to a base of the display device.

Figure 4:
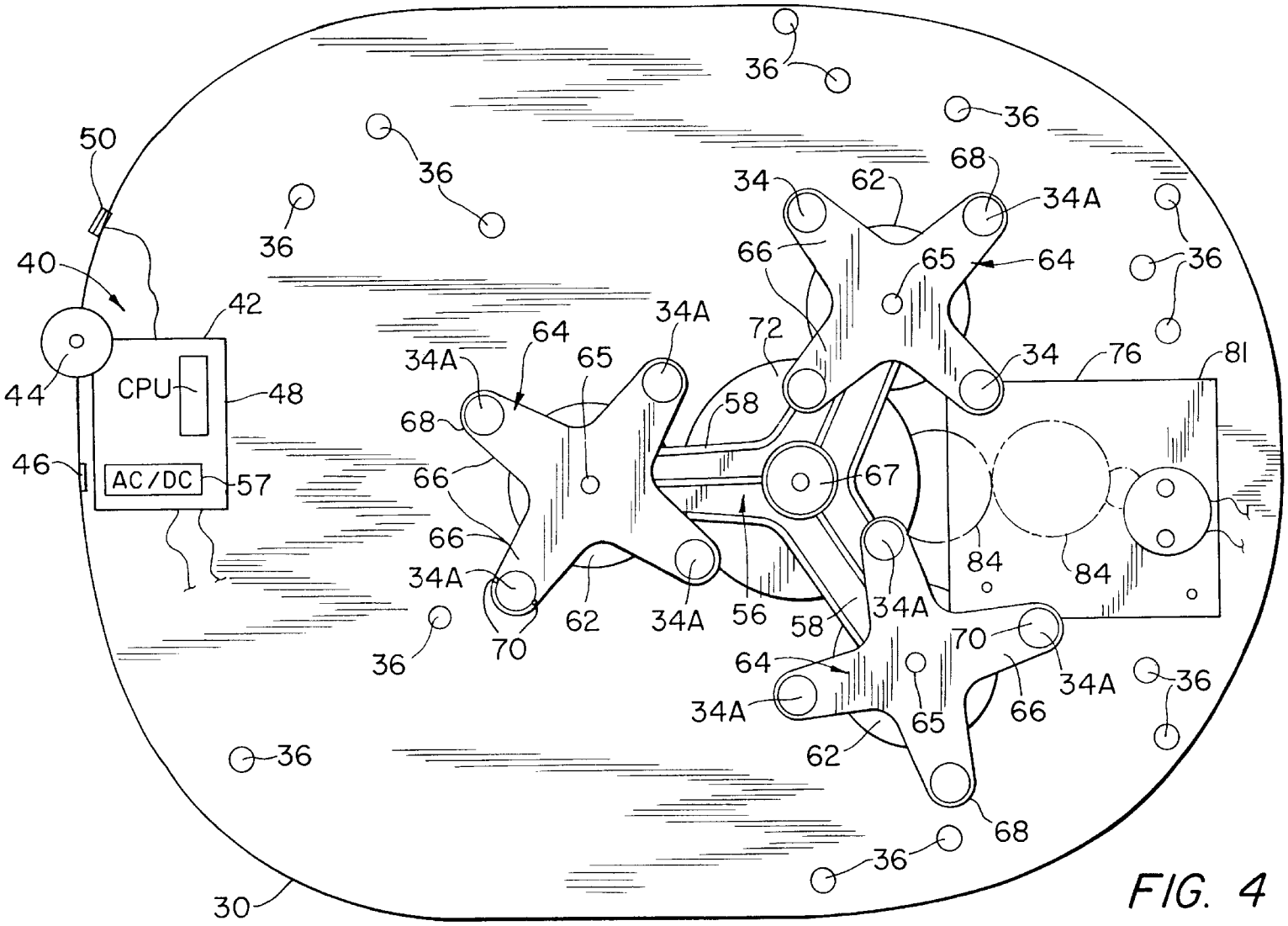
FIG. 4 is a top plan view of the display device, with the platform removed, in accordance with the first embodiment of the present invention.

FIG. 4 is a top view of the display device of the first embodiment with the platform removed, thus exposing a base 30 and a drive mechanism 32 for moving a plurality of magnets 34A. The base is ideally formed of a single piece of molded plastic, and provided with a plurality of integrally-formed posts 36 for supporting and receiving the platform 12 and the support 28 of the skating surface by conventional fixing means such as screws. The base also supports and houses the components necessary to operate the animated display device.

A controller 40 for operating the display device includes a control board 42, an on/off switch 44 with a volume control and a female adapter 46 for receiving an electrical cord supplying AC power to the controller. The control board is capable of playing music as the figurines "skate", that is, move, on the platform, and in that regard includes a CPU 48 with a memory for storing, among other information, a plurality of songs. In addition, a speaker (not shown) is provided to output the music, and a music change button 50 can be pressed to select a new song. The speaker can be secured to the underside of the platform to simulate music being played in the pavilion. In this embodiment, a rotary on/off switch 44 is provided to easily adjust the volume of the music.

Preferably, the control board includes a conventional AC to DC converter circuit 51 for supplying DC current to the CPU to play music, and also to a motor 52 for operating the drive mechanism 32. In this regard, a DC motor is best suited for actuating the drive mechanism.

As will be appreciated, each of the elements shown in block outline in FIG. 4, (as well as in FIG. 9 described below in connection with the second embodiment), is well known, and a specific type of construction is not critical to carrying out the invention or to a disclosure of the best mode for carrying out the invention.

The drive mechanism 32 for moving the magnets in the first embodiment of the invention is disposed directly beneath the skating surface and will be described with reference to FIGS. 4, 5A and 6.

Figure 5A:
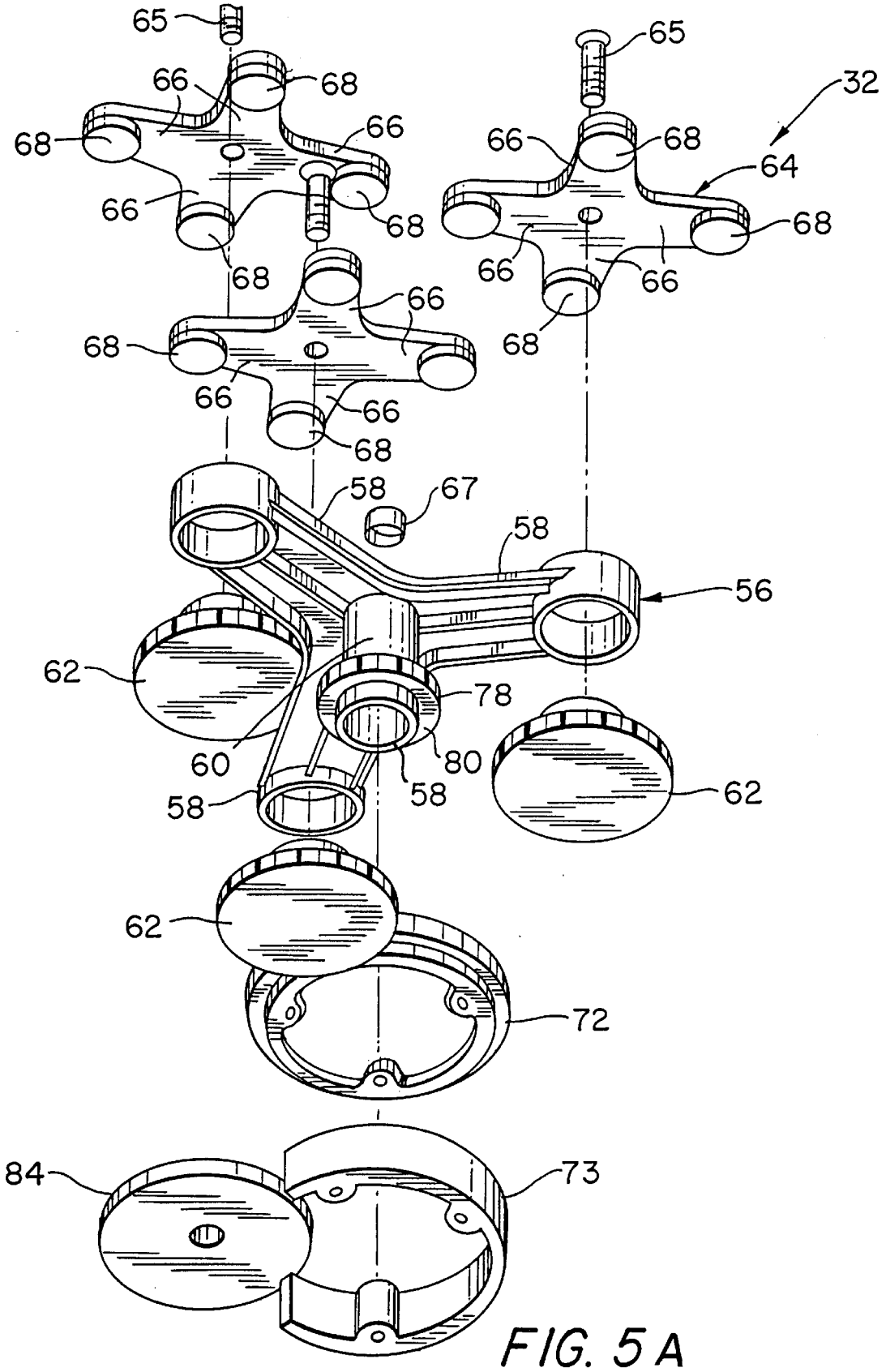
FIG. 5A is an exploded perspective view of a drive mechanism in accordance with the first embodiment of the invention, viewed from below the component parts.

As best seen in FIGS. 4 and 5A, the drive mechanism features a planetary gear system for supporting and moving a first set of magnets 34A. The planetary gear system includes a multi-arm planetary gear support 56 having a plurality of arms 58 extending radially from a central post or axis 60. In this embodiment, three arms 58 are provided. Preferably, the arms are symmetrically spaced from each other, which in this embodiment would result in the arms being spaced 120° apart.

The terminal end of each arm 58 supports a planetary gear 62 and a multi-finger magnet support 64 affixed to the planetary gear. The multi-finger magnet support 64 has four, preferably symmetrically-spaced, fingers 66, each capable of supporting a magnet 34A at its terminal end. The magnets 34A are placed in depressed pockets 68 of the fingers and can be secured therein by glue or other comparable means if desired. Small, molded prongs 70, shown in FIG. 6, can be formed to extend upwardly from each pocket and serve as spacers.

Figure 6:
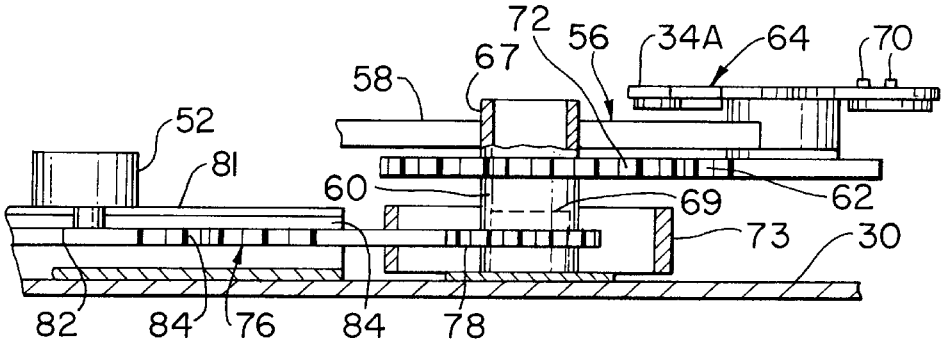
FIG. 6 is a side elevational view of the drive mechanism along plane VI–VI in FIG. 4 in accordance with the first embodiment of the invention.

An end cap 67 rotatably secures the central post 60 of the planetary gear support 56 to a fixed shaft 69 as best seen in FIG. 6. In this embodiment, the fixed shaft extends upwardly from and is part of the molded base 30.

In the arrangement shown in FIGS. 4 through 6, the planetary gear 62 and magnet support 64 sandwich the arm 58 and are secured to each other by conventional fixing means, such as a screw 65. Of course, comparable ways to support the planetary gear and the magnet support to the planetary gear support 56 can be used without departing from the scope of the invention.

Figure 5B:
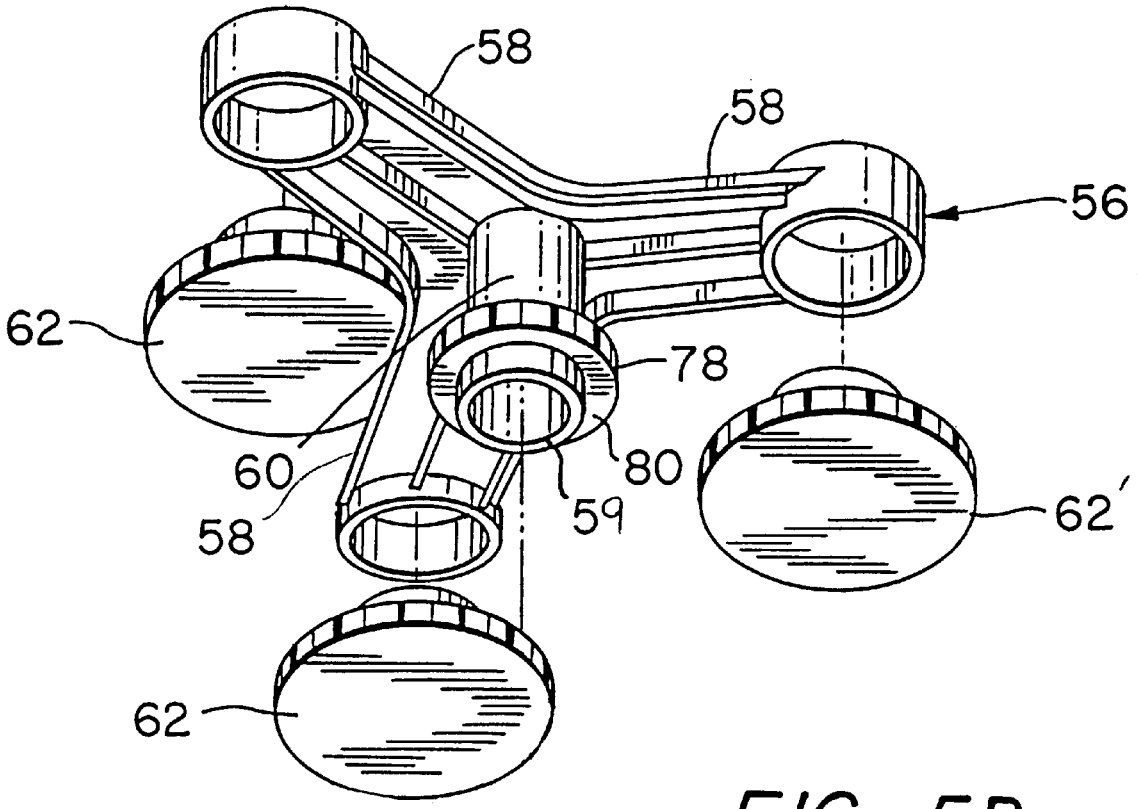
FIG. 5B is an isolated perspective view of a modified part of the drive mechanism shown in FIG. 5A.

As part of the planetary gear system 54, a sun gear 72 is fixed to a rim 73 on the base 30 and is concentric with the central post 60 of the planetary gear support 56. The rim elevates the sun gear to the same horizontal plane as the planetary gears 62. In this arrangement, each planetary gear will mesh with the stationary sun gear, and therefore will rotate about its own rotational axis as it revolves around the sun gear when the planetary gear support 56 is rotated. The planetary gears 62 can be made to be the same size as in FIG. 5A, that is, having the same diameter, as each other. Alternatively, their sizes can vary as shown in FIG. 5B to provide different rotational speeds. In FIG. 5B, for example, planetary gear 62' is larger in circumference than planetary gears 62. Of course, the larger the size of the planetary gear the more teeth it will have and the slower its rotational speed, measured in rpm's, will be.

The planetary gear support 56 is rotated about its rotational axis by a gear train 76 as illustrated in FIGS. 4 through 6. As best seen in FIG. 5, the gear train includes a driven gear 78 that receives the central post 58 of the planetary gear support and is keyed thereto, for example, by a flat surface 80 on its internal diameter for mating with a flat face 59 of the central post. The gear train can include one or more intermediate gears 84 between the driven gear 78 and a drive gear 82. The drive gear is powered by the motor 52 through, for example, a conventional spindle rotated by the motor. As discussed above, the motor is preferably a DC motor, although an AC motor could also be used. Alternative means for rotating the planetary gear support, such as an endless belt and pulley arrangement, could be used without departing from the scope of the invention. Most of the gear train is disposed in a gear box 81 as shown in FIG. 4 and reaches the driven gear 78 through an open side of the rim 73. In this embodiment, the motor 52 is supported on the gear box 81.

Operation of the drive mechanism is initiated by the supply of power to the motor 52 by turning on the on/off switch 44. The motor drives the gear train 76 and ultimately the driven gear 78 to rotate the planetary gear support 56.

When the planetary gear support 56 is rotated, the first set of magnets 34A supported on the multi-fingered magnet support will travel in a first orbit, or pattern, around the rotational center of its respective magnet support 64, which is rotated by its associated planetary gear 62 via engagement with the sun gear 72. In addition, each magnet in the first set of magnets will travel in a second orbit about the rotational axis of the planetary gear support 56. The first set of magnets are disposed directly beneath the skating surface 14 of the platform to guide the mobile figurines over the skating surface. As the skating figurines encircle the skating surface by the magnetic force of the magnets travelling in the second orbit, the figurines will also skate in smaller, arcuate paths toward and away from the center of the ice by virtue of the magnets travelling in the first orbit. The skaters will thus move in a fluid, seemingly complex and random pattern over a large part of the skating surface.

The second embodiment of the invention will now be described with reference to FIGS. 7 through 11. The second embodiment includes substantially all of the features of the display device discussed above with respect to the first embodiment of the invention. Therefore, many of the components discussed above in connection with the first embodiment are given the same reference numerals in FIGS. 7 through 11 and will not have to be discussed in further detail. As will be appreciated, the second embodiment features a drive mechanism for supporting and moving a second set of magnets 34B and a third set of magnets 34C, in addition to the first set of magnets 34A.

Figure 7:
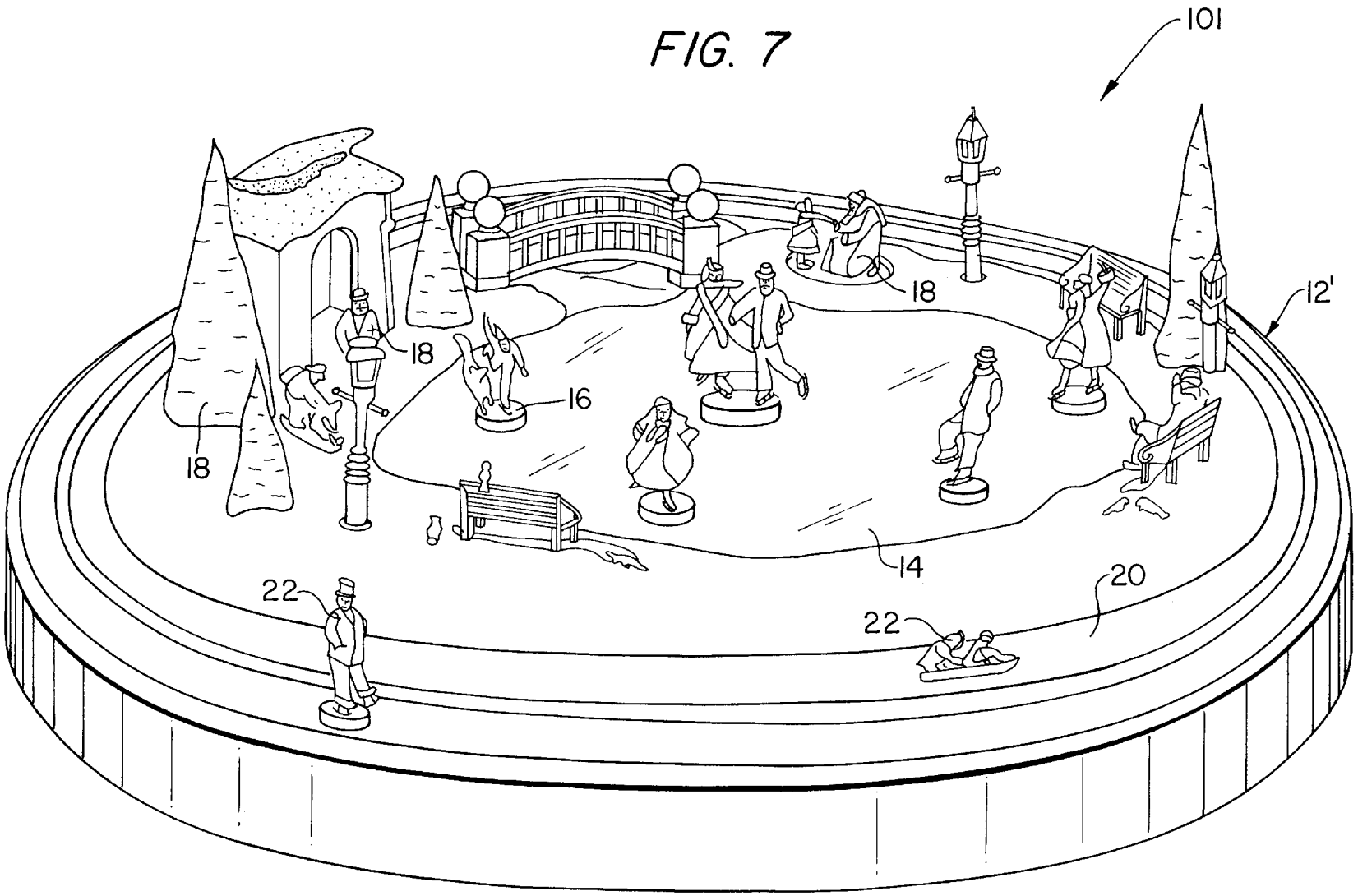
FIG. 7 is a perspective view of the animated display device in accordance with a second embodiment of the invention, showing a platform of the display device.

With reference first to FIG. 7, a platform 12' of the animated display 10' in accordance with the second embodiment differs from FIG. 1 in that tracks 20 encircling the skating surface 14 have been added. Two substantially concentric tracks are provided in this embodiment. Mobile FIGS. 22 are moved over the tracks by the additional magnets provided by the second embodiment. These FIGS. 22 are substantially identical to the mobile FIGS. 16 discussed above and shown in FIG. 2. It is preferred that in this embodiment, a single glass plate 27 be used for both the skating surface 14 and the tracks 20.

Figure 8:
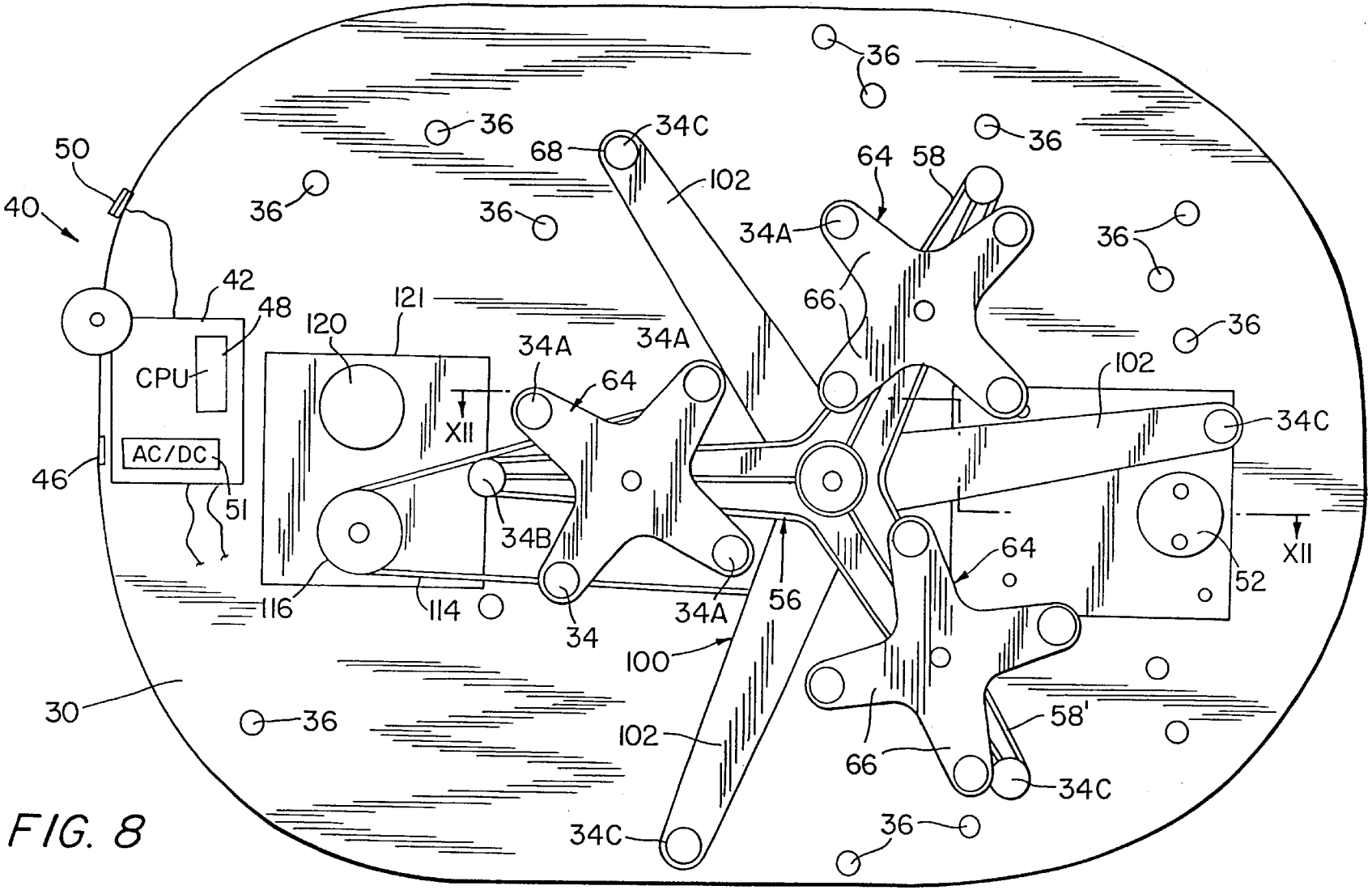
FIG. 8 is a top plan view of the display device, without the platform, in accordance with the second embodiment of the invention.

The drive mechanism 32 for moving the three sets of magnets 34A, 34B and 34C beneath the skating surface and the tracks 20 is illustrated in FIGS. 8 through The drive mechanism features a planetary gear system for supporting and moving the first and second sets of magnets. As will be appreciated by these figures, the planetary gear system of the second embodiment is similar in many of its aspects to the planetary gear system of the first embodiment. The primary difference is that in the second embodiment, the arms 58' of the planetary gear support 56' are extending in length. Therefore, each set of planetary gears 62 and structurally connected multi-finger magnet support 64 are supported at an intermediate portion of each arm 58' instead of the terminal end as in the first embodiment. At the terminal end of each arm is provided means, such as a pocket 68, for retaining additional magnets 34B of the second set of magnets.

Figure 11:
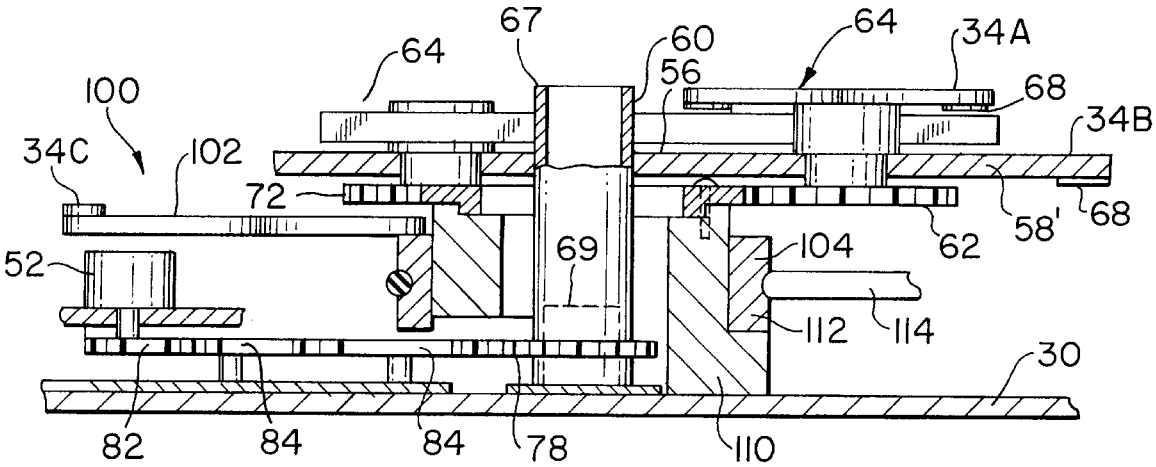
FIG. 11 is a side elevational view of the drive mechanism taken along plane XII—XII in FIG. 8 in accordance with the second embodiment of the invention.
Figure 9:
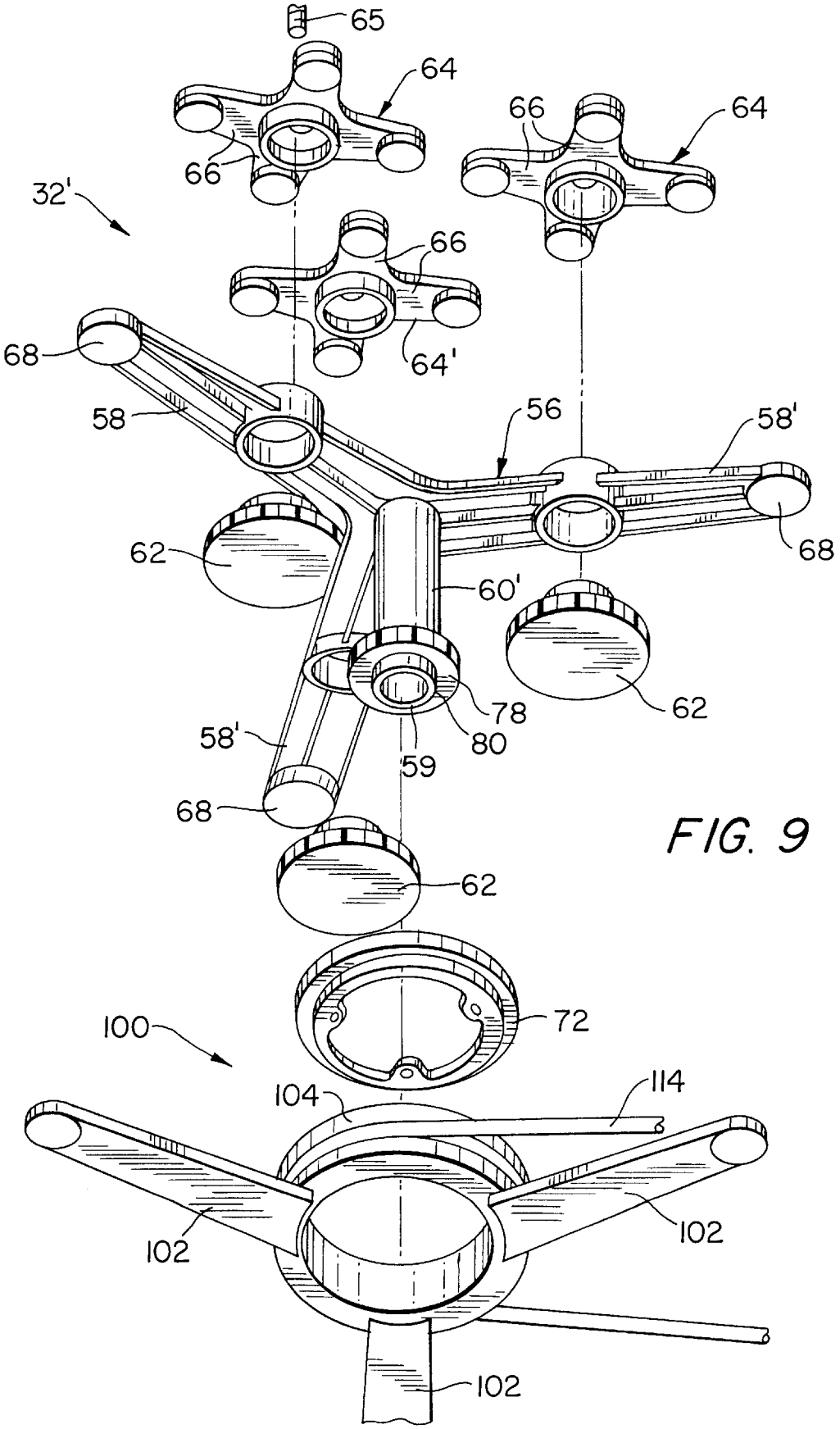
FIG. 9 is an exploded perspective view of a drive mechanism, viewed from below the component parts, in accordance with the second embodiment of the invention.
Figure 10:
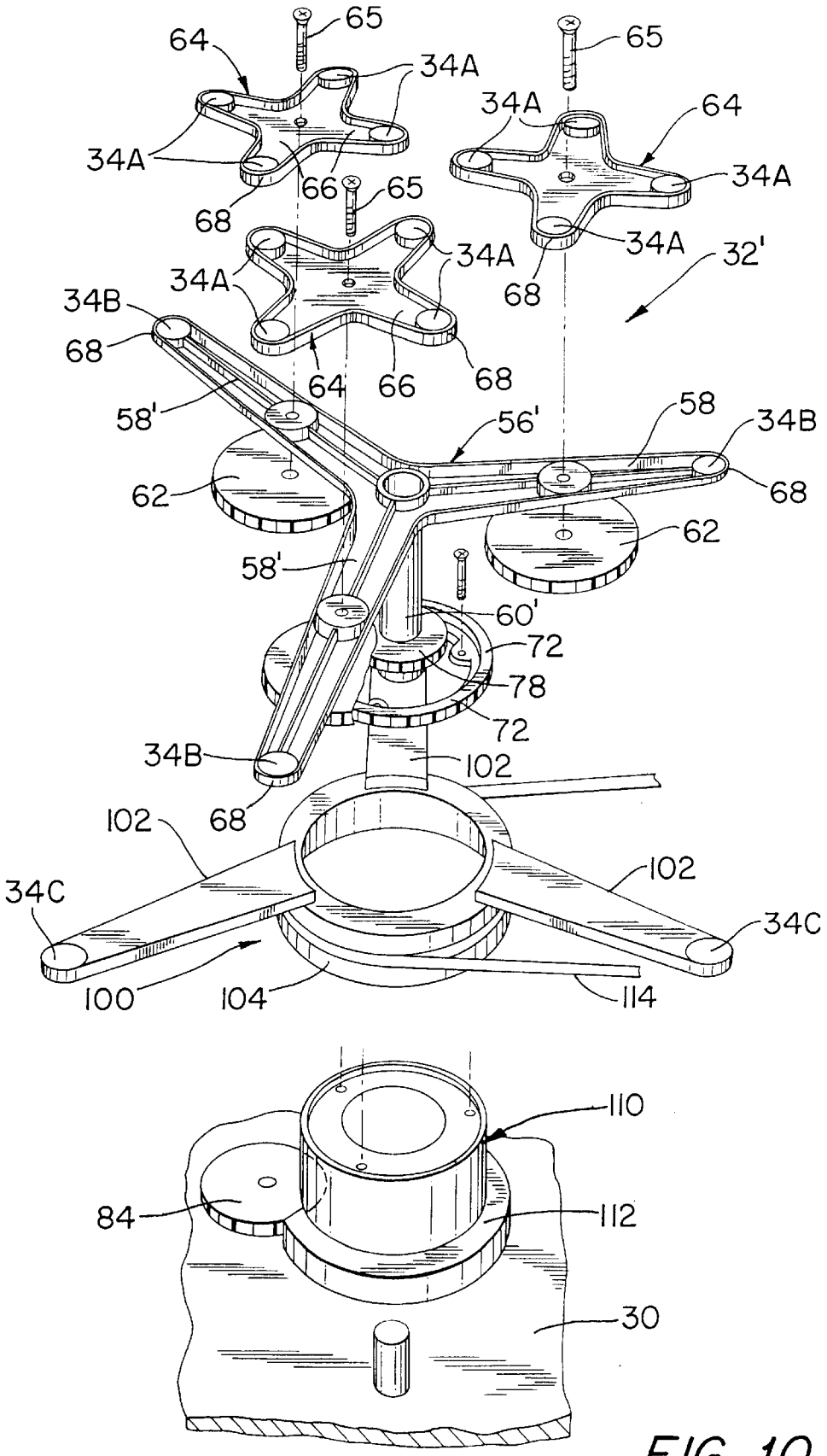
FIG. 10 is an exploded view of the drive mechanism, viewed from above the component parts, in accordance with the second embodiment of the invention.

The planetary gear support 56' can be rotated in the same manner disclosed above with respect to the first embodiment, that is, through a gear train 76 having a driven gear keyed to the central post 60' of the planetary gear support. In this embodiment, however, the length of the central post 60' is increased to accommodate an auxiliary magnet support 100 used to support the third set of magnets 34C. FIGS. 9 through 11 provide the best views of the central post 60'.

The auxiliary magnet support 100 is comprised of a plurality, for example, three, legs 102, extending radially from a circular base 104. The base is supported for rotation about a rim 110 extending upwardly from the base 30. The sun gear 72 is affixed to the rim for meshing engagement with the planetary gears in the same manner disclosed above with respect to the first embodiment. The rim 110 shown in FIG. 10 is preferably larger in circumference and height than the rim 73 shown in FIG. 5 in order to rotatably support the auxiliary magnet support. The rim can have a stepped portion 112 for supporting the auxiliary magnet support directly beneath the affixed sun gear.

A magnet of the third set can be secured at a terminal end of each leg 102 in substantially the same way as the first and second sets of magnets are secured, that is, by being positioned in a depressed pocket and secured therein by, for example, glue. Of course, other means for mounting and securing the sets of magnets can be used without departing from the scope of the invention.

As FIG. 8 best illustrates, the legs 102 are greater in length than the arms 58' of the planetary gear support 56'. Therefore, the third set of magnets is disposed further from the rotational center of the planetary gear support and will orbit in a fourth pattern having a greater circumference than the second set of magnets orbiting in third pattern.

With this arrangement, the second set of magnets 34B will be disposed beneath the inside circular track 20 on the platform 12 and the third set of magnets 34C will be disposed beneath the outer circular track 20 on the platform.

As discussed above, the auxiliary magnet support 100 is supported independently from the planetary gear support 56'. Therefore, additional means in the form of an endless belt and pulley arrangement are used to rotate the auxiliary magnet support. With reference to FIG. 8, the endless belt 114 is supported between a drive pulley 116 and the base 104 of the auxiliary magnet support, which can be grooved to better secure the belt. The drive pulley is driven by a motor 120 in a conventional manner such as, for example, a gear train which is not shown. Similarly to the first embodiment, a gear box 121 supports the motor 120 and the drive pulley 116 and houses the gear train by which the drive pulley is driven. As an alternative to the endless belt arrangement, a gear train or other comparable drive means could be used to directly rotate the auxiliary magnet support.

In operating the display device, power is supplied to both motors 52 and 120 by turning on the on/off switch 44. The motor 52 serves to rotate the planetary gear support 56', through the gear train 76, in the same manner discussed above in the first embodiment. The rotating planetary gear support moves the first and second sets of magnets. Power to motor 120 will rotate the auxiliary magnet support 100 through the endless belt to move the third set of magnets.

The first set of magnets 34A will travel beneath the skating surface 14 in the same manner discussed above in the first embodiment. That is, the first set of magnets will travel in a first orbit around the rotational center of its respective magnet support and in a second orbit about the central axis of the planetary gear support 56'. In addition, in this embodiment the second set of magnets 34B disposed at the terminal ends of the arms 68 will travel in a third orbit, with a circular pattern, about the rotational center of the planetary gear support. This third orbit will thus attract figurines over the inside track 20 of the platform. Similarly, the third set of magnets supported by the auxiliary support 82 will travel in a fourth orbit which is also circular, although of a greater circumference than the third orbit, for moving figurines over the outside track 20.

As will be appreciated, the first and second sets of magnets in the planetary gear support 56 are supported directly beneath the platform, while the third set of magnets in the auxiliary magnet support is positioned a slightly greater vertical distance from the platform. Thus, the third set of magnets may need to possess a stronger magnetic field to provide the same magnetic force on the platform as the first and second sets of magnets. Of course, factors such as the size and weight of the figurines, the coefficient of friction between the platform surface and the base of the figurines, and the like, will be readily taken into consideration by those skilled in the art in selecting the proper strength and size of magnets for attracting the figurines over the platform in a smooth and fluid manner.

Although specific embodiments of the present invention have been described above in detail, it will be understood that this description is merely for purposes of illustration. Various modifications of and equivalent structures corresponding to the disclosed aspects of the preferred embodiments in addition to those described above may be made by those skilled in the art without departing from the spirit of the present invention which is defined in the following claims, the scope of which is to be accorded the broadest interpretation so as to encompass such modifications and equivalent structures.

What is claimed is:

1. A magnet drive gear system for an animated display, comprising:

a base;

a sun gear fixed to said base and having a first central axis;

a planetary gear support mounted for rotational movement about the first central axis of said sun gear; first drive means for rotating said planetary gear support;

at least one planetary gear supported on said planetary gear support for rotation about a rotational axis and meshing with said sun gear, rotation of said planetary gear support rotating said planetary gear about its own rotational axis and revolving said planetary gear about the first central axis;

a magnet support platform affixed to said planetary gear for rotation therewith, with said planetary gear support sandwiched between said magnet support platform and said planetary gear, said magnet support platform including a plurality of radially-extending fingers; and at least one magnet supported in each of said fingers in said magnet support platform, wherein rotation of said planetary gear support revolves said magnet in a first pattern about the rotational axis of said planetary gear and in a second pattern about the central axis of said sun gear.

2. A magnet drive system according to claim 1, wherein said plurality of fingers are symmetrically spaced about a rotational center of said magnet support platform.

3. A magnet drive system according to claim 1, wherein said planetary gear support includes a plurality of radially extending arms, each rotatably supporting a planetary gear and a magnet support platform.

4. A magnet drive system according to claim 3, wherein said plurality of arms are symmetrically spaced about the central axis of said sun gear.

5. A magnet drive system according to claim 3, wherein a terminal end of each said arm supports one of said planetary gears and a magnet support platform.

6. A magnet drive system according to claim 3, wherein an intermediate portion of each said arm supports one of said planetary gears.

7. A magnet drive system according to claim 6, wherein a terminal end of each said arm supports a magnet for concentric travel about the central axis of said sun gear.

8. A magnet drive system according to claim 1, further comprising an auxiliary magnet support mounted for rotation about the central axis of said planetary gear support.

9. A magnet drive system according to claim 8, wherein said auxiliary magnet support includes a plurality of legs symmetrically supported about its rotational center, with each leg supporting a magnet for concentric travel about the central axis of said sun gear.

10. A magnet drive system according to claim 9, further comprising second drive means for driving said auxiliary magnet support, said second drive means including an endless belt, a drive pulley for driving said endless belt, and a motor for driving said drive pulley, wherein said endless belt is secured between said drive pulley and said auxiliary magnet support.

11. A magnet drive system according to claim 1, wherein said first drive means includes a gear train having a driven gear secured to said planetary gear support, a drive gear for driving said driven gear, and a motor for driving said drive gear.

12. A magnet drive system according to claim 1, further comprising a plurality of planetary gears rotatably supported on said planetary gear support.

13. A magnet drive system according to claim 12, wherein at least two of said planetary gears rotate at different speeds from each other.

14. A magnet drive system according to claim 1, further comprising a display surface mounted adjacent said magnet.

15. A magnet drive system according to claim 14, further comprising at least one figurine including metallic means attractable to said magnet, whereby said figurine can be placed on said surface to be moved thereon by said magnet when said magnet is driven in said first and second patterns, thereby to provide said animated display.

16. A magnet drive system for an animated display, comprising:

a base;

a sun gear fixed to said base and having a first central axis;

a planetary gear support mounted for rotational movement about the first central axis of said sun gear;

first drive means for rotating said planetary gear support;

at least one planetary gear rotatably supported on said planetary gear support for rotation about a rotational axis and meshing with said sun gear, rotation of said planetary gear support rotating said planetary gear about its own rotational axis and revolving said planetary gear about the first central axis;

a magnet support platform affixed to said planetary gear for rotation therewith and for supporting a first set of magnets, with said planetary gear support sandwiched between said magnet support platform and said planetary gear, said magnet support platform including a plurality of radially-extending fingers;

an auxiliary magnet support mounted for rotation about the central axis of said planetary gear platform; and second drive means for rotating said auxiliary magnet support, wherein said planetary gear support includes first means for supporting a second set of magnets and said auxiliary magnet support includes second means for supporting a third set of magnets, and rotation of said planetary gear support moves the first set of magnets in a first pattern about the rotational axis of said planetary gear and in a second pattern about the central axis of said sun gear and moves the second set of magnets in a third pattern about the central axis of said sun gear, and rotation of said auxiliary magnet support moves the third set of magnets in a fourth pattern about the central axis of said sun gear.

17. A magnet drive system according to claim 16, wherein each of said plurality of fingers supports one magnet of the first set of magnets.

18. A magnet drive system according to claim 16, wherein said planetary gear support includes a plurality of radially extending arms, each rotatably supporting a planetary gear and a magnet support platform.

19. A magnet drive system according to claim 18, wherein an intermediate portion of each said arm supports one of said planetary gears and a magnet support platform.

20. A magnet drive system according to claim 19, wherein a terminal end of each said arm includes said first means for supporting one magnet of the second set of magnets.

21. A magnet drive system according to claim 16, further comprising a display surface mounted adjacent said magnet.

22. A magnet drive system according to claim 21, further comprising at least one figurine including metallic means attractable to said magnet, whereby said figurine can be placed on said surface to be moved thereon by said magnet when said magnet is driven in said first and second pattern, thereby to provide said animated display.

23. A magnet drive system according to claim 16, wherein every magnet supported in said fingers is spaced from the rotational axis of said magnet support platform.

24. An animated display device, comprising:

a base;

a sun gear fixed to said base and having a first central axis;

a planetary gear support mounted for rotational movement about the first central axis of said sun gear;

first drive means for rotating said planetary gear support;

at least one planetary gear supported on said planetary gear support for rotation about a rotational axis and meshing with said sun gear, rotation of said planetary gear support rotating said planetary gear about its own rotational axis and revolving said planetary gear about the first central axis;

first magnetic support means for supporting a first set of magnetic means and being affixed to said planetary gear for rotation, with said planetary gear support sandwiched between said first magnetic support means and said planetary gear, said first magnetic support means including a plurality of radially-extending fingers;

at least one magnetic means of the first set of magnetic means supported in each said finger of said first magnetic support means;

a display surface mounted adjacent said magnetic means;

at least one animated figure movable over said display surface, at least one of said magnetic means and said figure comprising a magnet attractable to the other thereof, wherein rotation of said planetary gear support revolves the first set of magnetic means in a first pattern about the rotational axis of said planetary gear and in a second pattern about the central axis of said sun gear, thereby to move said animated figure in said first and second patterns on said display surface.

25. An animated display device according to claim 24, wherein said planetary gear support includes a plurality of radially extending arms, each rotatably supporting a planetary gear and first magnetic support means.

26. An animated display device according to claim 25, wherein an intermediate portion of each said arm supports one of said planetary gears and said first magnetic support means.

27. An animated display device according to claim 25, further comprising third magnetic support means for supporting a third set of magnetic means for rotation about the central axis of said sun gear.

28. An animated display device according to claim 27, further comprising second drive means for driving said third magnetic support means.

29. An animated display device according to claim 27, wherein said third magnetic support means includes a plurality of legs symmetrically supported about its rotational center, with one magnetic means of the third set of magnetic means supported at a terminal portion of each said leg.

30. An animated display device according to claim 24, further comprising second magnetic support means for supporting a second set of magnetic means for rotation about the central axis of said sun gear.

31. An animated display device according to claim 30, wherein a terminal end of each said arm comprises said second magnetic support means for supporting the second set of magnetic means.

32. An animated display device according to claim 24, wherein said plurality of fingers are symmetrically spaced about a rotational center of said first magnetic support means.

33. An animated display device according to claim 24, wherein said planetary gear support includes a plurality of radially extending arms, each rotatably supporting a planetary gear and a magnetic support means.

34. An animated display device according to claim 33, wherein said plurality of arms are symmetrically spaced about the central axis of said sun gear.

35. A magnet drive gear system for an animated display, comprising:

a base;

a sun gear fixed to said base and having a first central axis;

a planetary gear support mounted for rotational movement about the first central axis of said sun gear;

first drive means for rotating said planetary gear support;

at least one planetary gear supported on said planetary gear support for rotation about a rotational axis and meshing with said sun gear, rotation of said planetary gear support rotating said planetary gear about its own rotational axis and revolving said planetary gear about the first central axis;

a magnet support platform affixed to said planetary gear for rotation therewith, said magnet support platform including a plurality of radially-extending fingers; and at least one magnet supported in each of said fingers in said magnet support platform, wherein every magnet supported in said fingers is spaced from the rotational axis of said magnet support platform, and wherein rotation of said planetary gear support revolves said magnet in a first pattern about the rotational axis of said planetary gear and in a second pattern about the central axis of said sun gear.

36. A magnet drive system according to claim 35, wherein said plurality of fingers are symmetrically spaced about a rotational center of said magnet support platform.

37. A magnet drive system according to claim 35, wherein said planetary gear support includes a plurality of radially extending arms, each rotatably supporting a planetary gear and a magnet support platform.

38. A magnet drive system according to claim 37, wherein said plurality of arms are symmetrically spaced about the central axis of said sun gear.

39. A magnet drive system according to claim 37, wherein a terminal end of each said arm supports one of said planetary gears and a magnet support platform.

40. A magnet drive system according to claim 37, wherein an intermediate portion of each said arm supports one of said planetary gears.

41. A magnet drive system according to claim 40, wherein a terminal end of each said arm supports a magnet for concentric travel about the central axis of said sun gear.

42. A magnet drive system according to claim 35, further comprising an auxiliary magnet support mounted for rotation about the central axis of said planetary gear support.

43. A magnet drive system according to claim 42, wherein said auxiliary magnet support includes a plurality of legs symmetrically supported about its rotational center, with each leg supporting a magnet for concentric travel about the central axis of said sun gear.

44. A magnet drive system according to claim 43, further comprising second drive means for driving said auxiliary magnet support, said second drive means including an endless belt, a drive pulley for driving said endless belt, and a motor for driving said drive pulley, wherein said endless belt is secured between said drive pulley and said auxiliary magnet support.

45. A magnet drive system according to claim 35, wherein said first drive means includes a gear train having a driven gear secured to said planetary gear support, a drive gear for driving said driven gear, and a motor for driving said drive gear.

46. A magnet drive system according to claim 35, further comprising a plurality of planetary gears rotatably supported on said planetary gear support.

47. A magnet drive system according to claim 46, wherein at least two of said planetary gears rotate at different speeds from each other.

48. A magnet drive system according to claim 35, further comprising a display surface mounted adjacent said magnet.

49. A magnet drive system according to claim 48, further comprising at least one figurine including metallic means attractable to said magnet, whereby said figurine can be placed on said surface to be moved thereon by said magnet when said magnet is driven in said first and second patterns, thereby to provide said animated display.

50. An animated display device, comprising:

a base;

a sun gear fixed to said base and having a first central axis;

a planetary gear support mounted for rotational movement about the first central axis of said sun gear;

first drive means for rotating said planetary gear support;

at least one planetary gear supported on said planetary gear support for rotation about a rotational axis and meshing with said sun gear, rotation of said planetary gear support rotating said planetary gear about its own rotational axis and revolving said planetary gear about the first central axis;

first magnetic support means for supporting a first set of magnetic means and being affixed to said planetary gear for rotation, with said first magnetic support means including a plurality of radially-extending fingers;

at least one magnetic means of the first set of magnetic means supported in each said finger of said first magnetic support means, with every magnet supported in said fingers being spaced from the rotational axis of said magnet support platform;

a display surface mounted adjacent said magnetic means;

at least one animated figure movable over said display surface, at least one of said magnetic means and said figure comprising a magnet attractable to the other thereof, wherein rotation of said planetary gear support revolves the first set of magnetic means in a first pattern about the rotational axis of said planetary gear and in a second pattern about the central axis of said sun gear, thereby to move said animated figure in said first and second patterns on said display surface.

51. An animated display device according to claim 50, wherein said planetary gear support includes a plurality of radially extending arms, each rotatably supporting a planetary gear and first magnetic support means.

52. An animated display device according to claim 51, wherein an intermediate portion of each said arm supports one of said planetary gears and said first magnetic support means.

53. An animated display device according to claim 51, wherein a terminal end of each said arm comprises said second magnetic support means for supporting the second set of magnetic means.

54. An animated display device according to claim 51, further comprising third magnetic support means for supporting a third set of magnetic means for rotation about the central axis of said sun gear.

55. An animated display device according to claim 54, further comprising second drive means for driving said third magnetic support means.

56. An animated display device according to claim 54, wherein said third magnetic support means includes a plurality of legs symmetrically supported about its rotational center, with one magnetic means of the third set of magnetic means supported at a terminal portion of each said leg.

57. An animated display device according to claim 50, further comprising second magnetic support means for supporting a second set of magnetic means for rotation about the central axis of said sun gear.

58. An animated display device according to claim 50, wherein said plurality of fingers are symmetrically spaced about a rotational center of said first magnetic support means.

59. An animated display device according to claim 50, wherein said planetary gear support includes a plurality of radially extending arms, each rotatably supporting a planetary gear and a magnetic support means.

60. An animated display device according to claim 59, wherein said plurality of arms are symmetrically spaced about the central axis of said sun gear.

* * * * *

UNITED STATES PATENT AND TRADEMARK OFFICE

CERTIFICATE OF CORRECTION

PATENT NO. : 5,915,853

DATED : June 29, 1999

INVENTOR(S): XING GUILIN

It is certified that error appears in the above-identified patent and that said Letters Patent is hereby corrected as shown below:

COLUMN 6:

Line 40, "through" should read --through 11.--.

COLUMN 10:

Line 24, "pattern," should read --patterns,--.

Signed and Sealed this

Eighteenth Day of April, 2000

*Attest:*

Q. TODD DICKINSON

*Attesting Officer*

*Director of Patents and Trademarks*